US008087160B1

(12) United States Patent
Tarpill et al.

(10) Patent No.: US 8,087,160 B1
(45) Date of Patent: Jan. 3, 2012

(54) SCISSOR ACTION COMPRESSION ASSEMBLY TOOL

(75) Inventors: Andrew J. Tarpill, East Haddam, CT (US); Tadeusz Zagula, Hartford, CT (US)

(73) Assignee: Capewell Components Company, LLC, Cromwell, CT (US)

( * ) Notice: Subject to any disclaimer, the term of this patent is extended or adjusted under 35 U.S.C. 154(b) by 934 days.

(21) Appl. No.: 11/941,111

(22) Filed: Nov. 16, 2007

(51) Int. Cl.
*H01R 43/042* (2006.01)

(52) U.S. Cl. ..... 29/751; 29/753; 29/758; 72/409.08; 72/409.14

(58) Field of Classification Search ..... 29/751, 29/753, 758; 72/409.01, 409.08, 409.14, 72/311, 712; 81/373
See application file for complete search history.

(56) References Cited

U.S. PATENT DOCUMENTS 3,820,420 A 6/1974 Matthews
4,561,282 A * 12/1985 Hadden, Sr. ..... 72/409.08
5,138,864 A 8/1992 Tarpill
5,934,137 A 8/1999 Tarpill
6,112,404 A 9/2000 Tarpill
6,293,004 B1 * 9/2001 Holliday ..... 29/751
6,820,326 B1 * 11/2004 Tarpill et al. ..... 29/751
7,210,327 B1 5/2007 Tarpill et al.

* cited by examiner

*Primary Examiner* — Livius R Cazan
(74) *Attorney, Agent, or Firm* — DeLio & Peterson, LLC

(57) ABSTRACT

A compression assembly tool for attaching a connector to a coaxial cable includes a tool body that supports a connector to be compressed in a compression head, a fixed handle, a moving lever handle, and an axially sliding plunger. The lever handle is pivotally connected to the tool body at the front end and to a link at the back end. The connection of the link to the back end of the lever handle and the placement of pivot points at opposite ends of the lever handle provides a scissor action appearance. The relative lengths of the lever handle, plunger and link and the placement of the pivots provides high levels of compression force and sufficient compression travel by the plunger to compress connectors of different lengths while requiring only a very limited handle opening angle, which allows maximum hand strength to be applied to the tool handles.

19 Claims, 2 Drawing Sheets

SCISSOR ACTION COMPRESSION ASSEMBLY TOOL

BACKGROUND OF THE INVENTION

1. Field of the Invention

The present invention relates to compression assembly hand tools for attaching a connector to a coaxial cable by compressing the connector in a direction parallel to the axis of the cable. More specifically, the present invention relates to compression assembly tools that minimize the opening angle of the handles so that they operate in the range where the hand can apply the greatest closing force while still providing a long compression stroke. The invention also relates to compression assembly hand tools, which are preferably capable of compressing connectors of different sizes.

2. Description of Related Art

One known type of compression assembly hand tool is used to attach a connector to a coaxial cable by compressing the connector in a direction parallel to the axis of the cable. A variety of connector designs are available that are attached by compression assembly tools that apply the compression force in this axially parallel direction.

Connectors designed to be attached in this manner often have two components that slide into axial engagement when the axial compression force is applied. As the two components engage axially, one is forced radially inwards by the other to grip the coaxial cable and make a permanent connection.

An alternative connector design attached by a compression assembly tool of this type includes a weakened section of the body that is shaped to collapse radially inward as an axial compression force is applied. The inward collapse of the connector body permanently attaches the connector to the coaxial cable.

A conventional design for compression assembly hand tools includes a moving lever handle that rotates relative to the body of the tool and drives a link connected to the back end of an axially sliding plunger. The back of the connector adjacent to the emerging coaxial cable is supported by a compression surface on the tool body. The front of the connector is compressed towards the back of the connector by the axially sliding plunger as the handles are closed.

Examples of tools of this type are seen in U.S. Pat. No. 7,210,327 issued on May 1, 2007, U.S. Pat. No. 6,820,326 issued on Nov. 23, 2004, and U.S. Pat. No. 5,934,137 issued on Aug. 10, 1999, all of which are assigned to the assignee of the present application, Capewell Components Company, LLC of Cromwell Conn.

In order to achieve the compression force needed for such hand tools, the tool must be designed so that force applied to the moving lever handle by the user is multiplied as it is applied to the sliding plunger. One conventional method of achieving this force multiplication is by designing the tool so that the angle of rotation of the moving handle as it moves between open and closed positions is as large as possible. The greater this opening angle, the farther the lever handle moves and the less force that must be applied.

Typically, the handle opening angle is greater than 30 degrees, and often it is more than 40 degrees. Although the increased opening angle reduces the hand force that must be applied, it produces a tool that may be awkward for some users to operate. The larger the opening angle, the larger the hand required to simultaneously grasp both handles. Some users may initially require two hands for tools with very large handle opening angles.

Conventionally designed compression assembly tools achieve mechanical advantage by connecting one of the pivots driving the plunger at a point near the middle of the moving lever handle. In these designs, the lever handle extends well beyond the pivot it drives to maximize the leverage applied by the handle. However, the mechanical advantage achieved by extending the handle beyond the pivot it drives, i.e., by connecting the driving pivot at a point near the middle of the moving lever, results in an undesirably large handle opening angle.

The problem with large handle opening angles is accentuated when longer handles are used as may be desirable for some tools required to compress larger connectors. The longer handles are not only more difficult to grasp, they may create clearance problems when used in limited spaces.

Another problem with large opening angles is that a human hand can apply progressively greater force as the hand closes. When the opening angle is large, the user can only apply limited force to the handle. A compression assembly tool that can compress connectors without requiring a large opening angle would be desirable, as it would allow the user to operate the tool in the range where the human hand can most effectively apply the greatest force.

SUMMARY OF THE INVENTION

Bearing in mind the problems and deficiencies of the prior art, it is therefore an object of the present invention to provide compression assembly tool that is easily operated and does not need to open to a large handle opening angle.

It is another object of the present invention to provide a compression assembly tool that operates with low hand force.

Still other objects and advantages of the invention will in part be obvious and will in part be apparent from the specification.

The above and other objects, which will be apparent to those skilled in the art, are achieved in the present invention which is directed to a compression assembly tool for attaching a connector to a coaxial cable that includes a tool body having a compression head and a fixed handle. A plunger slides longitudinally relative to the tool body between an extended position in which the front end extends into the compression head and a retracted position.

At least one pair of split base supports is pivotally attached to the compression head for motion between an open position and a closed position. The split base supports are located on opposite sides of the coaxial cable and provide a bearing surface for supporting a back end of the connector during compression.

A lever handle is movable relative to the fixed handle between an open position and a closed position. The lever handle includes a front end pivot connecting the front end of the lever handle to the tool body and a back end pivot at the back end of the lever handle. By locating the pivots at the ends of the lever handle, substantially greater separation between these pivot points is provided than in prior art compression assembly tool designs. A link is pivotally connected at its opposite ends between the back end pivot of the lever handle and a plunger pivot located at the back end of the plunger.

In one aspect of the invention, the front end pivot of the lever handle is mounted to the tool body at a point that is closer to the pair of split base supports than the front end of the plunger. This provides for a very long lever handle which helps achieve good compression and sufficient compression distance travel of the plunger.

In another aspect of the invention, the fixed handle, the lever handle, the plunger and the link are all substantially parallel when the lever handle is moved to the closed position. The preferred design for the tool includes a back end of the lever handle that projects towards the fixed handle. This brings the back end pivot of the lever handle and the link into axial alignment behind the plunger when the lever handle is moved towards the closed position.

The arrangement of pivots and the relative lengths of the link and lever handle allow the compression assembly tool to provide compression with a lever handle opening angle of less than 30 degrees and preferably less than 20 degrees between the open and closed positions. The preferred design requires only 16 degrees of lever handle motion.

In still another aspect of the invention, a link pivot distance is defined by the distance between the back end pivot of the lever handle and the plunger pivot at the back end of the plunger, a lever handle pivot distance is defined by the distance between the front end pivot at the front end of the lever handle and the back end pivot at the back end of the lever handle, and the link pivot distance is at least fifty percent of the lever handle pivot distance.

In yet another aspect of the invention, a plunger length is defined by the distance from the front end of the plunger to the plunger pivot and the lever handle pivot distance is greater than the link pivot distance plus the plunger length.

The compression assembly tool is optionally provided with a handle spring connected to urge the lever handle towards the open position and a handle locking mechanism that moves into and out of interfering engagement with the plunger. The handle locking mechanism preferably includes a pin having an enlarged diameter section, a reduced diameter section, and first and second ends wherein the pin slides substantially perpendicular to the fixed handle between locked and unlocked positions, the first end of the pin extends out of one side of the tool body when the handle locking mechanism is in the locked position, the second end of the pin extends out of an opposite side of the tool body when the handle locking mechanism is in the unlocked position, the plunger includes an exterior groove, and the enlarged diameter section of the pin slides into the exterior groove of the plunger and into interfering engagement with the plunger when the pin is in the locked position.

The compression assembly tool is preferably provided with an additional pair of split base supports pivotally attached to the compression head. The two pairs of split base supports are spaced predefined distances from the front end of the plunger to accommodate connectors of different lengths.

In a further aspect of the invention, the split base supports include stop surfaces for contacting the body and bringing the split base supports into axial alignment with the plunger when the split base supports are in the closed position.

The front end of the plunger preferably comprises a plunger tip having threads engaged in the plunger, which allows the plunger tip to be longitudinally adjusted by rotating it relative to the plunger. The plunger is preferably provided with a locking screw for locking the plunger tip. The locking screw is threadedly engaged into the plunger transversely to the plunger tip.

In another aspect of the invention, the tool body includes a pair of opposed side surfaces, the split base supports include push surfaces extending outward from the opposed side surfaces of the body when the split base supports are in the closed position; and the split base supports pivot to the open position when the push surfaces are urged towards the side surfaces of the body.

In the most highly preferred embodiment of the invention, the split base supports are pivotally attached to the tool body via a common pivot and the split base supports substantially encircle the coaxial cable when the split base supports are in the closed position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 3:
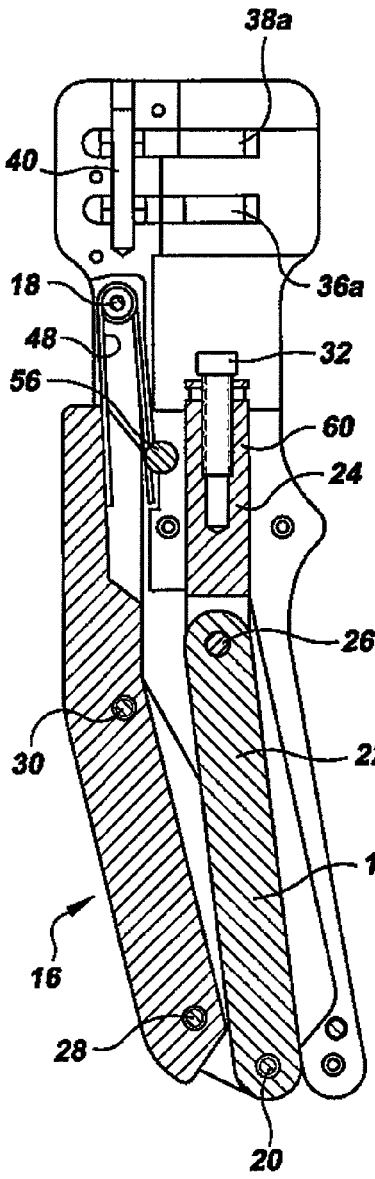
FIG. 3 is a cross-sectional view from the left side of the compression assembly tool shown in FIG. 2 taken along the line 3-3 in FIG. 2. The handle locking mechanism is still shown in the locked position holding the handles in the closed position.

In describing the preferred embodiment of the present invention, reference will be made herein to FIGS. 1-5 of the drawings in which like numerals refer to like features of the invention.

Referring to FIGS. 1-5, a preferred embodiment of the compression assembly tool includes a tool body 10 having a fixed handle 12 and a compression head 14. A lever handle 16 includes pivots 18, 20 at the front and back ends of the lever handle. The lever handle 16 is connected to the tool body through the front end pivot 18, which allows the lever handle to rotate relative to the fixed handle and the tool body through an opening angle of approximately 16 degrees. The back end of the lever handle is connected to a link 22 through the back end pivot 20.

The link 22 is connected to an axially sliding plunger 24 via plunger pivot 26. As may be seen in FIG. 4, as the handle 16 swings about the front end pivot 18, the back end pivot 20 pulls the link 22, which draws the plunger 24 away from the compression head.

Figure 1:
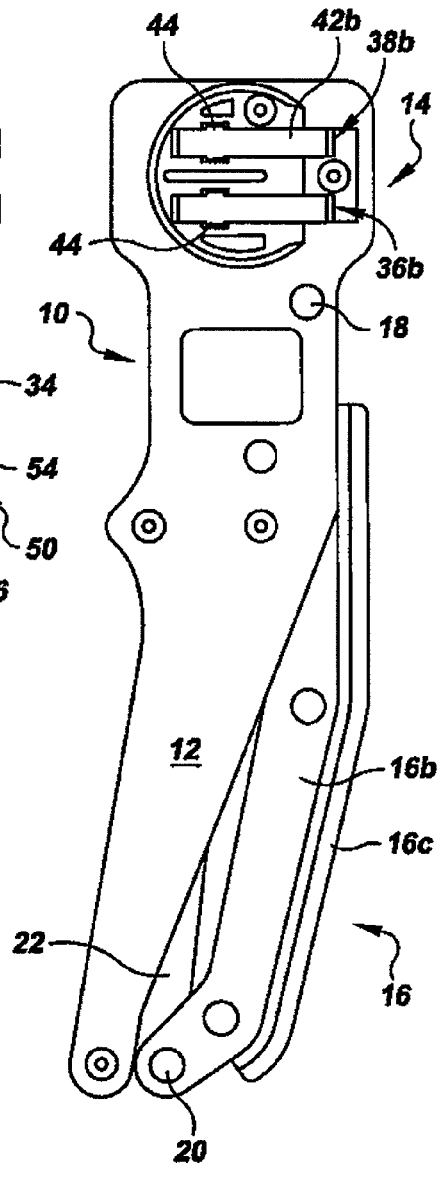
FIG. 1 is a left side view of a compression assembly tool according to the present invention. The handles are shown in the closed position.
Figure 5:
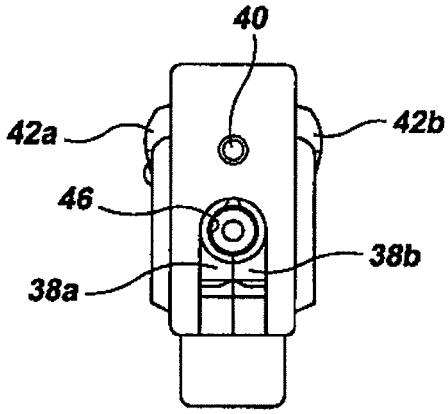
FIG. 5 is a front view of the compression assembly tool shown in FIG. 1.
Figure 4:
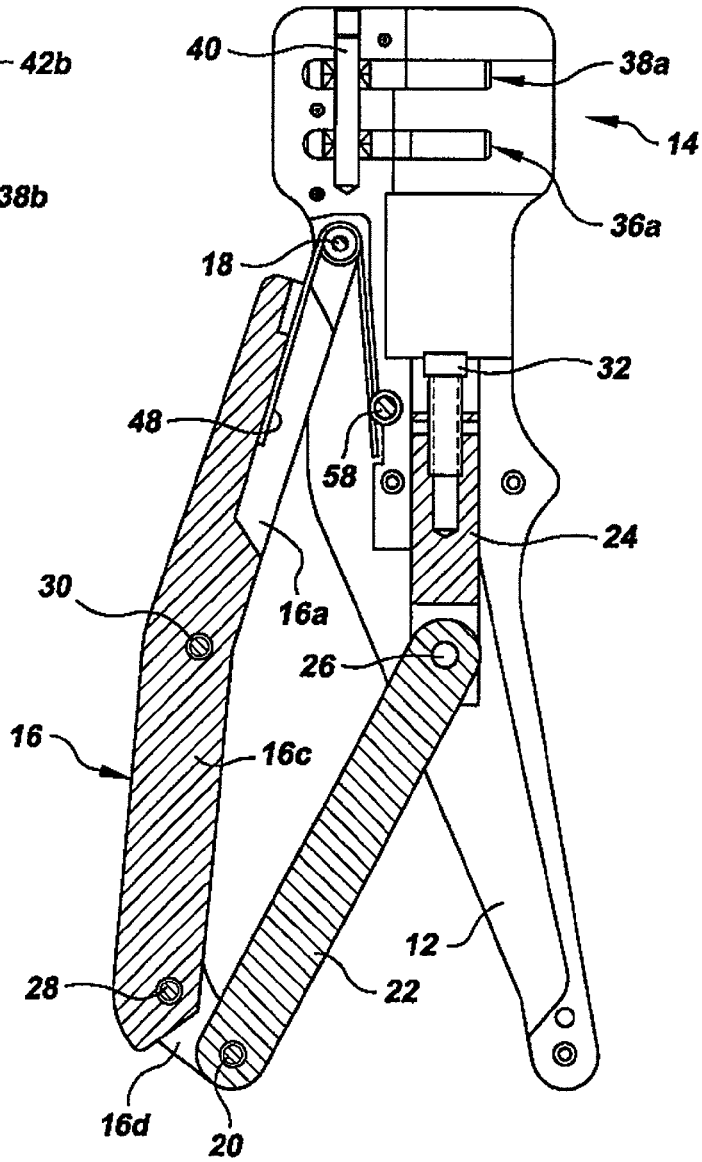
FIG. 4 is a left side cross-sectional view, similar to the view in FIG. 3, except that the handle locking mechanism is shown in the unlocked position and the handles are shown in the open position.

In the open position, as illustrated in FIG. 4, the lever handle has rotated approximately 16° from the closed position illustrated in FIGS. 1 and 3 and the tool presents a "scissor action" appearance. This appearance results from the location of the front and back end pivots 18, 20 at extreme opposite ends of the lever handle 16 and the relative lengths of the link 22, handle 16 and plunger 24.

Unlike prior art designs, the front end pivot 18 on the handle is located ahead of the front end of the plunger, while the back end pivot 20 is designed to swing into alignment directly behind the axis of the sliding plunger 24. The relatively longer distance between the pivots 18, 20 as compared to prior art designs allows the lever handle to move the plunger 24 the desired compression distance towards the compression head with a very limited opening angle of less than 20°. This small handle opening angle allows the lever handle and fixed handle to be easily gripped with a single hand and allows maximum hand closing force to be applied.

As compared to other tool designs in which the moving handle opens by more than 20° and typically more than 30° and up to 45°, the design of the tool as shown in FIGS. 1-5 is much more comfortable to operate while still providing substantial compression force. The plunger 24 moves by a compression distance of at least 0.50 inches (1.25 cm) in the preferred design with only 16 degrees of opening angle.

Another feature of the present design is that the link 22 has a length that is greater than 50 percent of the distance between the front and back end pivots 18, 20 on the lever handle. This design feature helps the plunger to move the desired compression distance relative to the front of the tool with the desirable small handle opening angle.

The lever handle 16 may be a single piece, but in the preferred embodiment shown, it is formed from a pair of opposed plates 16*a* and 16*b* separated by a plastic spacer 16*c*. The spacer extends out from and overlaps the plates 16*a* and 16*b* to provide a rounded and comfortable surface for gripping the handle on the surface away from the fixed handle. Rivets 28 and 30 are used to hold the lever handle 16 components together.

The back ends of the lever handle plates 16*a*, 16*b* are shaped as projections 16*d* that extend towards the fixed handle. These projections allow the back end pivot 20 on lever handle 16 to move into axial alignment directly behind the plunger 24 as the handle moves to the closed position. This may be seen in FIGS. 1 and 3 in which the lever handle 16, the plunger 24, the link 22 and the fixed handle 12 are all substantially parallel.

As may be seen in FIGS. 3 and 4, the front end pivot 18 on the lever handle is attached to the tool body at a point that is ahead of the front of the plunger 24. The length of the plunger 24 plus the length of the link 22 is less than the distance between the pivots 18, 20 at the opposite ends of the handle 16. This arrangement is unlike prior art designs in which the link connected between the handle and the plunger is normally attached to the middle of the lever handle to provide mechanical advantage.

The pivot 20 extends between the two plates 16*a* and 16*b*, which form the lever handle 16. The link 22 rotates about pivot 20 in the space provided by the plastic spacer 16*c* between the plate extensions 16*d*.

The plunger 24 includes a plunger tip 32 that is threadedly connected to the plunger 24. This allows the distance from the front of the plunger to the front end of the tool to be adjusted. The plunger tip 32 is held in place by a set screw 34 seen in FIG. 2. By loosening the set screw 34 and inserting a hexagonal adjustment tool into the tip 32 of the plunger 24, the plunger tip can be rotated to provide the desired adjustment of the distance from the front of the plunger to split base supports in the compression head.

The compression head 14 includes two pairs of split base supports. A first pair of split base supports 36*a*, 36*b* is located close to the plunger tip 32 while a second pair of split base supports 38*a*, 38*b* is located at an increased distance from the plunger tip 32.

The split base supports function to support the back end of a connector to be compressed. The two pairs of split base supports allow the tool to compress connectors of two different sizes and two different corresponding lengths. The split base supports all rotate on a common pivot 40. Each split base support can be pivoted to the open position around pivot 40 by pressing on a corresponding push surface 42*a*, 42*b*. Applying inward pressure on the push surfaces rotates the split base supports on the common pivot 40 allowing a coaxial connector and coaxial cable to be inserted into the compression head 14.

As can be seen in FIG. 1, each split base support includes a pair of projecting tabs 44 that contact the side of the tool body. The tab brings the split base support into accurate axial alignment with the plunger when the split base supports are in the closed position.

Each split base support preferably includes a semi-circular opening 46. The semi-circular openings close around the coaxial cable and support the back end of the connector being compressed. In the preferred design, the split base supports provide a full 360° support for the back end of the connector, although less than 360° of support is also effective.

Additional description of split base supports and, in particular, dual split base supports with stop surfaces and push surfaces can be found in U.S. Pat. No. 6,820,326, which is incorporated herein by reference in its entirety.

Referring to FIG. 3, the tool includes a handle spring 48, which is a torsion spring that passes around the front end pivot 18 of the lever handle 16. Handle spring 48 acts between the tool body and the lever handle 16 to drive the lever handle to the open position when pressure on the handles is released. As the lever handle moves to the open position (see FIG. 4) the plunger 24 is retracted.

Figure 2:
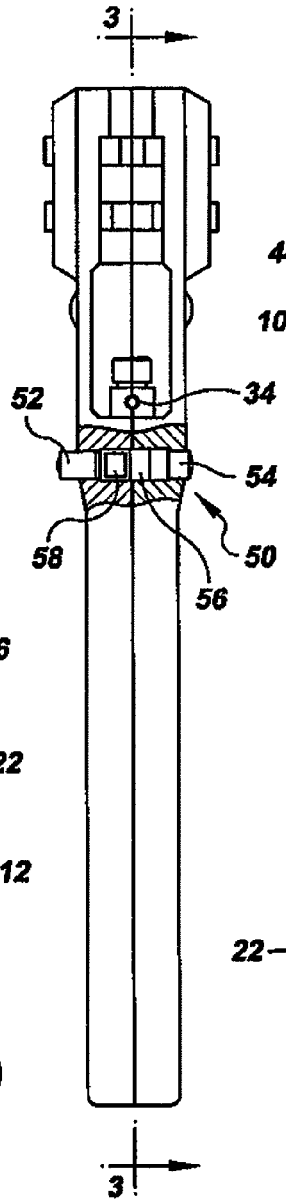
FIG. 2 is a bottom view of the compression assembly tool shown in FIG. 1 with a portion of the tool being cut away to show the handle locking mechanism. The handle locking mechanism is shown in the locked position to hold the handles in the closed position.

The tool can be locked in the closed position seen in FIGS. 1-3 by operating a handle locking mechanism that moves into and out of interfering engagement with the plunger. The handle locking mechanism may be seen in FIG. 2 and includes a pin 50 having a first end 52 and a second end 54. The pin 50 slides perpendicular to the tool body and is longer than the width of the tool body so that one end always protrudes from a side of the tool.

By exerting a force on pin end 52 that is directed along the axis of the pin, the pin slides so that pin end 52 is approximately flush with one side of the tool and pin end 54 projects out of the opposite side of the tool. This unlocks the tool and allows the lever handle to move freely to the open position. When force is applied to the opposite pin end 54 with the handles in the closed position, pin end 54 becomes approximately flush and pin end 52 returns to its original projecting position. This locks the lever handle in the closed position.

This locking action is achieved by relative motion between the central section of the pin and the plunger. The central section of pin 50 includes an enlarged diameter section 56 and a reduced diameter section 58. Referring to FIG. 3, which shows a cross section through the locked tool, it can be seen that the perimeter of the plunger 24 is provided with an exterior groove 60 that preferably extends around the entire perimeter of the plunger.

When pin 50 slides to the locked position, the enlarged diameter section 56 moves into the exterior groove 60 and into interfering engagement with the plunger. With the locking mechanism in this position, the plunger can no longer slide axially. It will be understood that the enlarged diameter section 56 can only move into interfering engagement with the plunger when the exterior groove 60 is in the correct alignment, which occurs only when the handles are closed.

With the plunger held in the position shown in FIG. 3, outward motion of the lever handle 16 is prevented. The handle is locked closed and the handle spring 48 remains compressed.

To release the handle locking mechanism, pin end 52 is pressed inwards until it is approximately flush with the side of the tool. Pin end 54 then extends outward from the side of the tool and the enlarged diameter section 56 moves out of interfering engagement with the groove 60. The plunger is then free to move to the retracted position seen in FIG. 4.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

Thus, having described the invention, what is claimed is:

1. A compression assembly tool for attaching a connector to a coaxial cable comprising:

a tool body including a compression head generally located at a front end of the tool body for receiving the connector and the coaxial cable in coaxial alignment along a compression axis; and a fixed handle generally located at a back end of the tool body;

a plunger having a front end for compressing the connector and a back end having a plunger pivot, the plunger being mounted for longitudinal sliding motion relative to the tool body along the compression axis between an extended position in which the front end of the plunger extends into the compression head and a retracted position;

a pair of split base supports pivotally attached to the compression head for motion between an open position and a closed position, the split base supports being located on opposite sides of the coaxial cable and providing a bearing surface for supporting a back end of the connector during compression;

a lever handle movable relative to the fixed handle between an open position and a closed position, the lever handle having a front end pivot proximate a front end of the lever handle and a back end pivot proximate a back end of the lever handle, the front end pivot being located offset from the compression axis to allow the coaxial cable and connector to be positioned on the compression axis and to allow the coaxial cable to extend perpendicularly past the front end pivot and out of the compression head at the front end of the tool body, the front end pivot on the front end of the lever handle being located closer to the front end of the tool body than the back end pivot on the back end of the lever handle, the front end pivot connecting the front end of the lever handle to the tool body; and a link pivotally connected at opposite ends between the back end pivot of the lever handle and the plunger pivot at the back end of the plunger.

2. The compression assembly tool of claim 1 wherein the front end pivot of the lever handle is closer to the pair of split base supports than the front end of the plunger.

3. The compression assembly tool of claim 1 wherein the fixed handle, the lever handle, the plunger and the link are all substantially parallel when the lever handle is moved to the closed position.

4. The compression assembly tool of claim 1 wherein the back end of the lever handle projects towards the fixed handle to bring the back end pivot of the lever handle and the link into axial alignment behind the plunger when the lever handle is moved towards the closed position.

5. The compression assembly tool of claim 1 wherein the fixed handle and the lever handle form an opening angle of less than 30 degrees when the lever handle is moved to the open position.

6. The compression assembly tool of claim 1 wherein the fixed handle and the lever handle form an opening angle of less than 20 degrees when the lever handle is moved to the open position.

7. The compression assembly tool of claim 1 wherein:

a link pivot distance is defined by the distance between the back end pivot of the lever handle and the plunger pivot at the back end of the plunger;

a lever handle pivot distance is defined by the distance between the front end pivot at the front end of the lever handle and the back end pivot at the back end of the lever handle; and the link pivot distance is at least fifty percent of the lever handle pivot distance.

8. The compression assembly tool of claim 1 wherein:

a link pivot distance is defined by the distance between the back end pivot of the lever handle and the plunger pivot at the back end of the plunger;

a lever handle pivot distance is defined by the distance between the front end pivot at the front end of the lever handle and the back end pivot at the back end of the lever handle;

a plunger length is defined by the distance from the front end of the plunger to the plunger pivot; and the lever handle pivot distance is greater than the link pivot distance plus the plunger length.

9. The compression assembly tool of claim 1 further including:

a handle spring connected to urge the lever handle towards the open position; and a handle locking mechanism, the handle locking mechanism moving into and out of interfering engagement with the plunger.

10. The compression assembly tool of claim 1 further including:

a handle spring connected to urge the lever handle towards the open position; and a handle locking mechanism comprising a pin having an enlarged diameter section, a reduced diameter section, and first and second ends wherein:

the pin slides substantially perpendicular to the fixed handle between locked and unlocked positions;

the first end of the pin extends out of one side of the tool body when the handle locking mechanism is in the locked position;

the second end of the pin extends out of an opposite side of the tool body when the handle locking mechanism is in the unlocked position;

the plunger includes an exterior groove; and the enlarged diameter section of the pin slides into the exterior groove of the plunger and into interfering engagement with the plunger when the pin is in the locked position.

11. The compression assembly tool of claim 1 further including:

an additional pair of split base supports pivotally attached to the compression head for motion between an open position and a closed position, the pair of split base supports and the additional pair of split base supports being spaced predefined distances from the front end of the plunger to accommodate connectors of different lengths.

12. The compression assembly tool according to claim 1 wherein the split base supports include a stop surface for contacting the body and bringing the split base supports into axial alignment with the plunger when the split base supports are in the closed position.

13. The compression assembly tool according to claim 1 wherein the front end of the plunger comprises a plunger tip having threads engaged in the plunger, the plunger tip being longitudinally adjustable by rotation relative to the plunger.

14. The compression assembly tool according to claim 13 wherein the plunger includes a locking screw for locking the plunger tip, the locking screw being threadedly engaged into the plunger transversely to the plunger tip.

15. The compression assembly tool according to claim 1 wherein:

the tool body includes a pair of opposed side surfaces;

the split base supports include push surfaces extending outward from the opposed side surfaces of the body when the split base supports are in the closed position; and the split base supports pivot to the open position when the push surfaces are urged towards the side surfaces of the body.

16. The compression assembly tool according to claim 1 wherein the split base supports are pivotally attached to the tool body via a common pivot.

17. The compression assembly tool according to claim 1 wherein the split base supports substantially encircle the coaxial cable when the split base supports are in the closed position.

18. The compression assembly tool according to claim 1 wherein the lever handle includes a pair of opposed handle plates and the link is pivoted between the opposed handle plates.

19. The compression assembly tool according to claim 18 further including a handle spring located between the opposed handle plates and acting between the tool body and the lever handle to urge the lever handle to the open position.

* * * * *